United States Patent [19]

Proctor et al.

[11] Patent Number: 4,694,968

[45] Date of Patent: Sep. 22, 1987

[54] TIGHTLY SEALING SAFETY CAP

[75] Inventors: John D. Proctor; Edward J. Towns, both of Summit; Edward M. Brown, Livingston, all of N.J.

[73] Assignee: Lermer Packaging Corp., Garwood, N.J.

[21] Appl. No.: 876,474

[22] Filed: Jun. 20, 1986

[51] Int. Cl.[4] ..... B65D 55/02

[52] U.S. Cl. ..... 215/224; 215/223

[58] Field of Search ..... 215/216, 223, 224, 317

[56] References Cited

U.S. PATENT DOCUMENTS 3,901,401 8/1975 Lynn et al. ..... 215/224

3,907,145 9/1975 Horvath ..... 215/224

*Primary Examiner*—George T. Hall

*Attorney, Agent, or Firm*—Charles E. Temko

[57] ABSTRACT

A safety type cap for medicinal or similar containers capable of effecting a tight seal upon the container mouth by means of a sealing flange extending laterally from an inner surface of the cap rim which is deflected upon contact with a corresponding flange on an area surrounding the mouth of the container. The cap is held in sealed relation relative to the container by engagement of a pair of arcuate projections which engage a sufficient degree of the container periphery so as to resist dislodgement made possible by flexing of the container without alignment of the cap relative to the container for normal usual disengagement.

1 Claim, 4 Drawing Figures

TIGHTLY SEALING SAFETY CAP

BACKGROUND OF THE INVENTION

This invention relates generally to the field of container closures, and more particularly to an improved safety type closure or cap adapted to effect a substantially tight seal with respect to the mouth of the container.

As defined by National Formulary, since NF 7 effective from 1942, a "well closed" container protects the content of the container from extraneous solids and from loss of the contents under ordinary or customary conditions of handling, shipment, storage and distribution.

By contrast, a "tight" container protects the contents from contamination by extraneous liquids, solids and vapors, from loss of a drug, and from efforescence, deliquescence or evaporation under the ordinary or customary conditions of handling, shipment, storage and distribution, and, additionally, is capable of tight reclosure. As a general rule, a tight container must offer moisture, permeability some 20 times less than a "well closed" container.

More recently, because of increased standards of safety from the standpoint of discovery and appropriation of the contents by children of tender years, container closures have been designed to require knowledgeable manipulation on the part of the user to open the closure, as a result of which recourse to the screw thread type of closure has been severely limited when a "tight" closure is required.

The most common type of safety closure employs a peripheral rim having a least one interrupted segment. A corresponding projection on the cap is rotatably aligned with the interrupted segment during the opening procedure, following which the cap may be lifted at this point to pivot the cap from the container. An example of this type of closure is disclosed in U.S. Pat. No. 3,669,295 of June 13, 1972, granted to William Horvath. Unlike screw type closures, in which the degree of tightness of the closure depends upon the degree the cap is twisted relative to the container, snap type caps have a uniform degree of tightness which depends, among other factors, upon the degree of distortion imparted to the synthetic resinous components of the cap, and the elastic modulus of the material from which the cap is made. While it is possible to manufacture threaded type safety caps, included a freely turning outer shell which is engaged with an inner element upon the application of axially directed pressure upon the shell, such constructions are expensive, and require the provision of a resilient jacket of compressible material lining the end wall of the cap.

In the U.S. Pat. No. 4,087,016 to Townes, et al., granted Apr. 2, 1978, and assigned to the same asignee as the assignee of the present application, there is disclosed a tightly sealing safety cap which may be utilized in conjunction with either a synthetic resinous or glass container which fulfills substantially all of the above mentioned criteria. However, in recent years there has been a growing tendency to manufacture the container from a synthetic resinous material which possesses a substantial degree of resiliency, albeit far less than that of the cap. Where the container is of relatively small size, as is often the case when the container is used for storage of prescription drugs, it is possible for children of tender years to attempt to remove the cap by inserting the open end of the container into the mouth so as to be engaged between the jaws of the child. Children of even tender years normally possess very powerful jaws, and are capable of distorting the cross sectional shape of the container from circular to ovate, often to a degree which sufficiently lessens the purchase of the cap upon the container, to permit the child to further flex the cap and remove it from engagement of the container without the necessity of aligning the usual index means with a corresponding vertical slot in the flange surrounding the mouth of the container. It is an object of the present invention to provide improved cap construction which will eliminate the possibility of such disengagement.

SUMMARY OF THE INVENTION

Briefly stated, the invention contemplates the provision of an improved safety type snap cap and container therefore, in which the container includes an open mouth bordered by an outer surface defining an annular flange having an indicated open segment. The cap has correspondingly located inner flange elements selectively engageable therewith, including a flange which is selectively alignable with the open segment of the annular flange on the container to allow removal of the cap with proper manipulation. The end wall of the cap is relatively thin in cross section, and is capable of being flexed to permit such removal. The flange means on the cap is of sufficent arcuate length, that should the container be distorted to non-circular cross sectional configuration, the degree of mechanical engagement on at least part of the engaging flange will be increased, rather than decreased, to prevent removal of the cap until the index means and corresponding projection have been aligned in a normal manner.

BRIEF DESCRIPTION OF THE DRAWING

In the drawing, to which reference will be made in the specification, similar reference characters have been employed to designate corresponding parts throughout the several veiws.

DETAILED DESCRIPTION OF THE DISCLOSED EMBODIMENT

Figure 1:
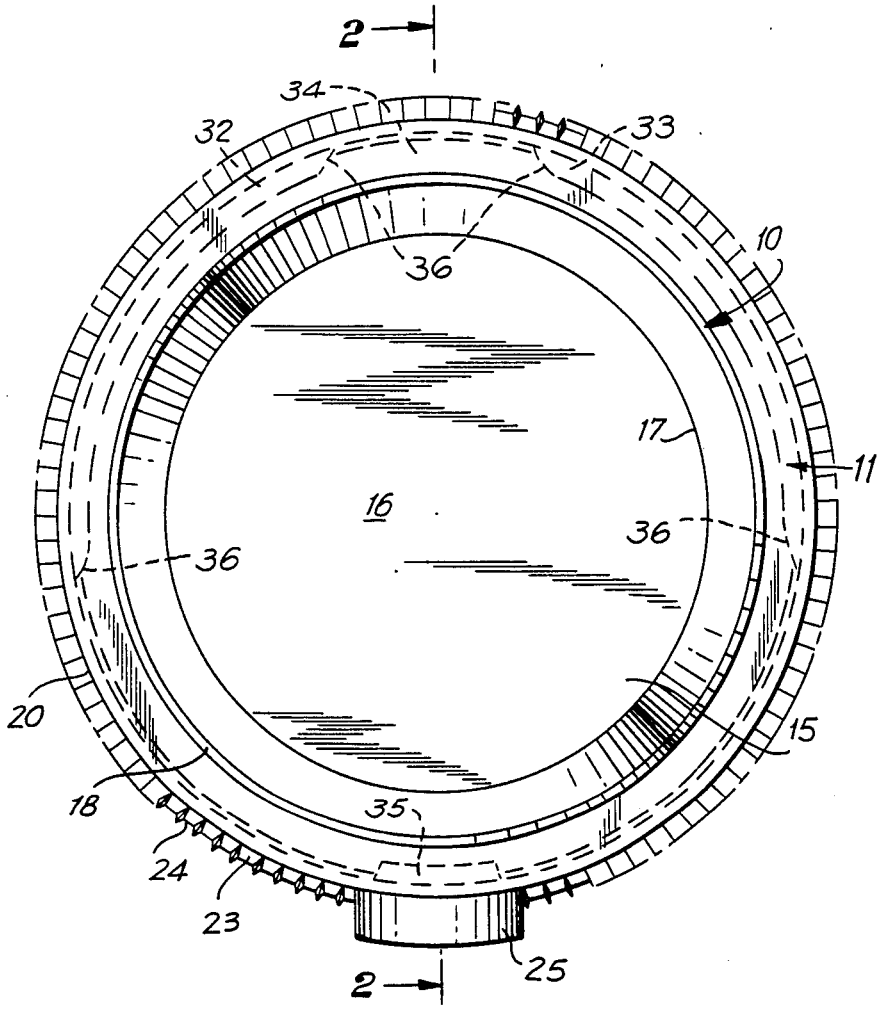
FIG. 1 is a top plan view of a synthetic resinous cap forming part of a disclosed embodiment of the invention.
Figure 2:
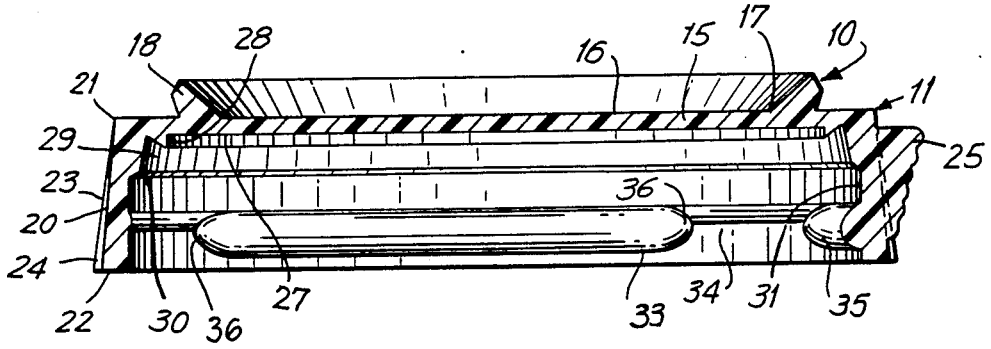
FIG. 2 is a transverse central sectional view thereof, as seen from the plane 2—2 in FIG. 1.
Figure 3:
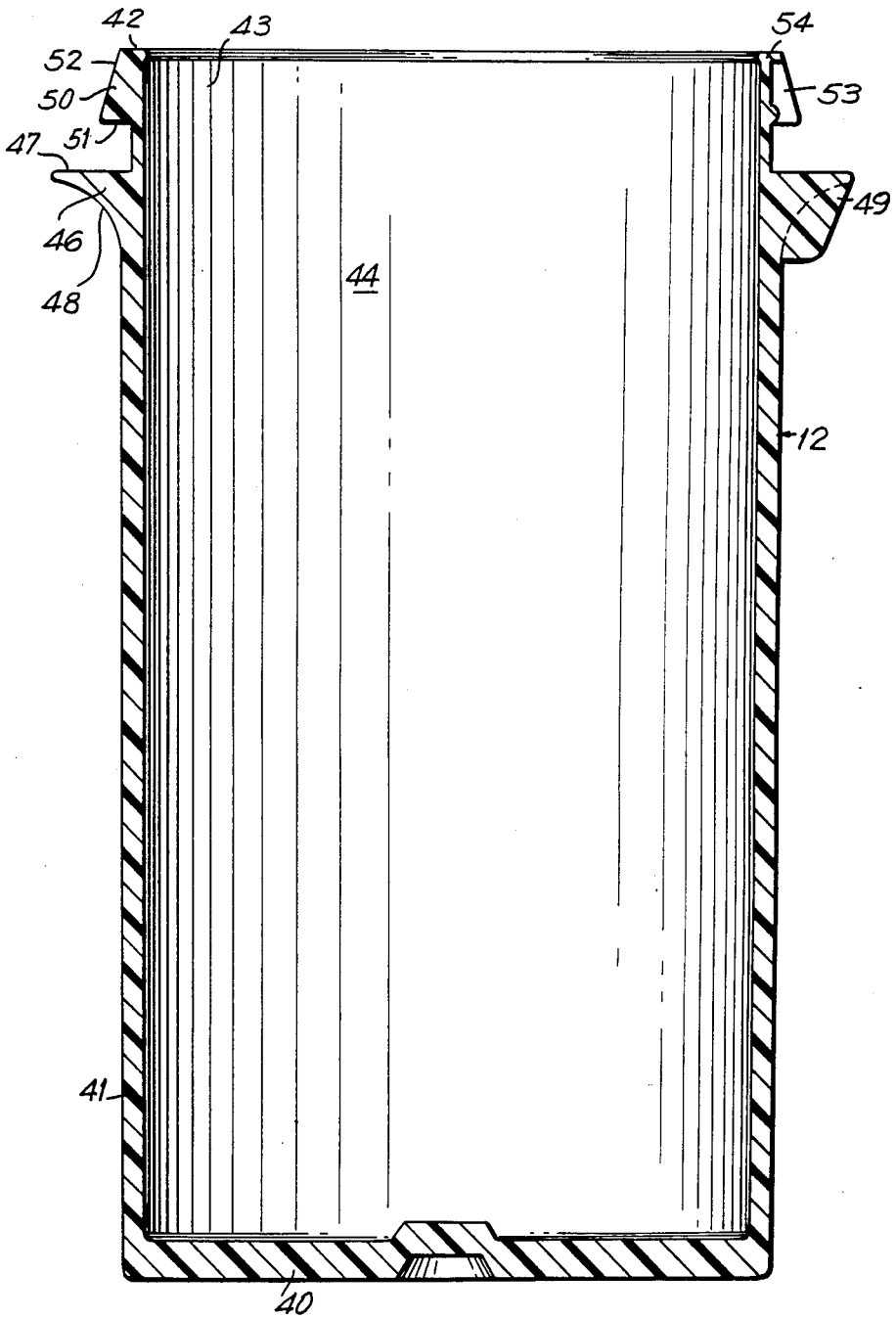
FIG. 3 is a vertical central sectional view of a corresponding container forming a part of the embodiment.
Figure 4:
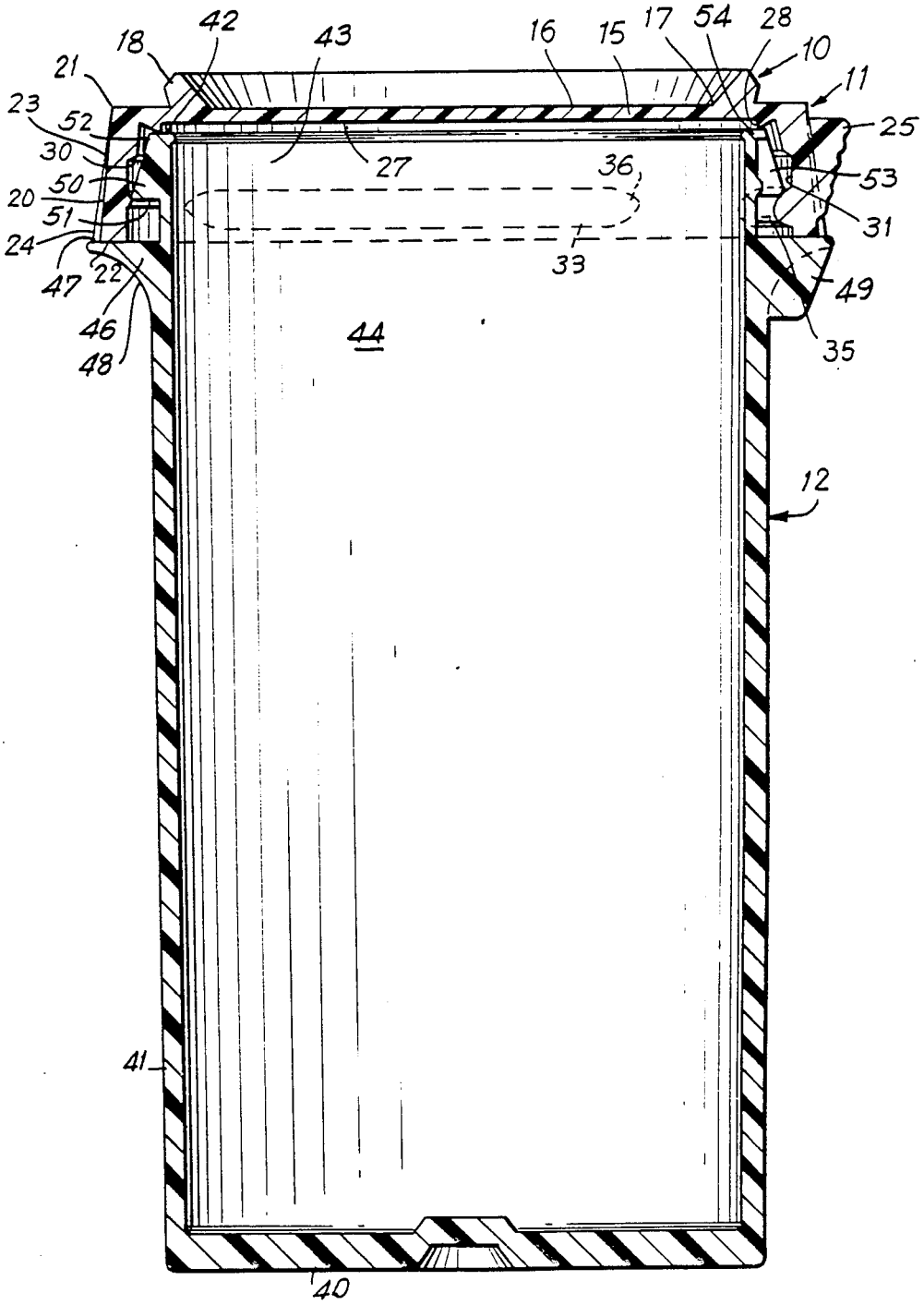
FIG. 4 is a longitudinal sectional view showing the structure of FIGS. 2 and 3 in interconnected condition.

In accordance with the invention, the device, generally indicated by reference character 10, comprises broadly: a cap element 11, and a corresponding container element 12. These elements are preferably formed by injection moulding, well known in the art, using known synthetic resinous materials.

The cap element is most suitable formed from polyethylene, or materials possessing similar properties, and includes a relatively thin end wall 15 having an outer surface 16 bounded by a circular edge 17. Extending outwardly from the surface 16, is an axially aligned flange 18 selectively engageable within the mouth of the container element 12 under conditions in which safety conditions are not required.

Surrounding end wall 15 is a peripheral rim 20 bounded by an outer edge 21 and an inner edge 22. An outer generally frusto-conical surface 23 is provided with finger engaging slots 24 to facilitate manual rotation of the cap element relative to the container element so that an index tab 25 may be aligned with a corresponding slot on the container element 12 to permit removal of the cap element from the container element in well known manner. An inner surface 27 of the end wall 15 is bordered by a peripheral edge 28 from which an integrally moulded sealing flange 29 extends in a direction toward the edge 22. The flange 29 is bordered by an edge 30, from which extends a generally cylindrical surface 31 which supports first and second arcuate locking flanges 32 and 33 which are separated by a small gap 34. The gap 34 is opposite a small projection 35 which is selectively alignable with the corresponding structure on the container element as the index tab 25 is positioned with corresponding index means on the container element. As best seen in FIG. 1, the flanges 32 and 33 which comprise the principal locking means on the cap element are provided with rounded terminals at 36 for reasons of mechanical strength, and to facilitate disengagement.

The container element 12 will normally be fabricated from synthetic resinous materials which are less flexible than those of the cap, but which are never the less possessed of a degree of flexibility which will permit distortion. The container element 12 includes a bottom wall 40 and a cylindrical side wall 41 terminating at an upper edge 42 defining an open mouth 43 leading to a smooth inner surface 44. Surrounding the mouth 43 is a first or inner flange member 46 having a planar upper surface 47 and a converging lower surface 48 which also mounts index means 49 selectively alignable with the tab 25. A second retainer flange 50 is positioned in parallel relationship relative to the flange member 46, and is bounded by a lower planar wall 51 and a frusto-conical wall 52. The flange 50 includes a transversely extending slot 53 which may be bounded by a flexible flashing 54 which assists in maintaining a sealed relation.

As is well known in the art, devices of this type are readily opened by rotating the cap element 11 relative to the container element 12 until the index tab 25 is aligned with the index means 49, at which point the slot 53 is aligned with the projection 35. An outwardly applied pressure to the tab 25 enables the cap element to be flexed so that the cap element is progressively disengaged from the container element, the locking flanges 32 and 33 being moved clear of the corresponding portions of the flange 50 as the rim of the cap element is distorted.

Should the container element 12 be manipulated by a child, in such manner that the mouth 43 is distorted from other than circular cross sectional configuration, as might occur if an infant is to place the mouth of the container between his teeth, whatever flexing occurs in the flange 50 will be transmitted to the rim 20 of the cap element, so that the flanges 32 and 33 will be retained at least as tightly as occurs in the absence of such distortion. Thus, the child is not likely to be able to create a gap between the edge 22 of the rim 30 and the planar surface 47 of the flange member 46 into which he can insert his teeth or other instrument to pry the cap element loose from the container element. This action will not, of course, occur in those cases where the flanges 32 and 33 extend over a peripheral angular distance of less than 180 degrees.

We wish it to be understood that we do not consider the invention limited to the precise details of structure shown and set forth in this specification, for obvious modifications will occur to those skilled in the art to which the invention pertains:

We claim:

1. In a combination container and flexible safety type cap therefor, the container including an open end portion defining a mouth and having a peripheral flange thereon, at least one segment of which is discontinuous, said gap including a generally planar end wall, a cylindrical side wall, and a plurality of inwardly facing projections selectively engaging said peripheral flange when said cap is in engaged condition upon said container, improved sealing means comprising: said container having a flange thereon surrounding said mouth, said flange having a frusto-conical surface thereon, said cap having a rim member having an inner surface corresponding to said frusto-conical surface to effect a sealing action therebetween, and retaining flange means on a second inner surface of said cap selectively positionable beneath said frusto-conical surface to effect a locking action between said cap and said container, said retaining flange means having an angular length of at least one-hundred eighty degrees and substantially less than three hundred sixty degrees; and a projection in coplanar relation relative to said retaining flange means and alignable within a discontinuous segment of said peripheral flange to permit disengagement of said cap, said projection being generally opposite a midpoint on said flange retaining means; whereby upon the flexing of said container to other than circular cross-sectional configuration at the mouth thereof, said retaining flange means on said cap will flex to like cross-sectional configuration to resist other than normal manipulation to disengage said cap from said container.

* * * * *